US006842603B2

(12) United States Patent
Ishii

(10) Patent No.: US 6,842,603 B2
(45) **Date of Patent: *Jan. 11, 2005**

(54) IMAGE FORMING METHOD USING AN INTERMEDIATE TRANSFER MEMBER HAVING LOW ADHESION AREA

(75) Inventor: Koichi Ishii, Kanagawa (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/737,898

(22) Filed: Dec. 18, 2003

(65) Prior Publication Data

US 2004/0126154 A1 Jul. 1, 2004

Related U.S. Application Data

(62) Division of application No. 10/187,973, filed on Jul. 3, 2002, now Pat. No. 6,694,120.

(30) Foreign Application Priority Data

Jul. 4, 2001 (JP) ..... P2001-203846

(51) Int. Cl.[7] ..... G03G 15/16
(52) U.S. Cl. ..... 399/308
(58) Field of Search ..... 399/302, 303, 399/308, 237, 99, 101; 430/126

(56) References Cited

U.S. PATENT DOCUMENTS 5,469,247 A 11/1995 Cheng et al.
5,510,886 A 4/1996 Sugimoto et al.
5,561,510 A 10/1996 Kamp et al.
5,636,349 A 6/1997 Landa et al.
5,666,193 A 9/1997 Rimai et al.
5,745,829 A 4/1998 Gazit et al.
5,873,018 A 2/1999 Aoto et al.
6,463,248 B1 10/2002 Jia et al.
6,594,463 B2 7/2003 Watanabe
6,694,120 B2 * 2/2004 Ishii ..... 399/308

FOREIGN PATENT DOCUMENTS

JP 3-77514 12/1991
JP 2000066533 A 3/2000
JP 2000227697 A 8/2000
JP 2001-296750 10/2001

* cited by examiner

*Primary Examiner*—Robert Beatty
(74) *Attorney, Agent, or Firm*—Oblon, Spivak, McClelland, Maier & Neustadt, P.C.

(57) ABSTRACT

A method for forming an image including carrying an image formed with toner particles on a surface of an image carrier; transferring the image from the surface of an image carrier to a first area of an intermediate transfer medium that includes a first area and second area having an adhesion lower than that of the first area; and transferring the image from the first area to a recording medium fed by a feeding mechanism.

15 Claims, 8 Drawing Sheets

IMAGE FORMING METHOD USING AN INTERMEDIATE TRANSFER MEMBER HAVING LOW ADHESION AREA

CROSS REFERENCE TO RELATED APPLICATION

This application is a divisional application of parent application Ser. No. 10/187,973, filed Jul. 3, 2002, U.S. Pat. No. 6,694,120, which is based upon and claims the benefit of priority under 35 CFR §120 and claims the benefit of priority under 35 USC §119 from the prior Japanese Patent Application No. P2001-203846, filed on Jul. 4, 2001; the entire contents of which are incorporated herein by reference.

BACKGROUND OF THE INVENTION

1. Field of the Invention

This invention relates to image forming techniques involving image transfer using an intermediate transfer medium.

2. Description of the Related Art

Wet electrophotography using liquid toner has recently been revalued because of its advantages over dry electrophotography. The advantages include high definition comparable to that of offset printing by use of minute toner particles of submicron size, the reduction in copying cost using a small amount of liquid toner, providing sufficient image density, and energy saving through the deposition of images of toner particles onto a recording medium (recording paper) at a relatively low temperature.

A direct electric field transfer system has conventionally been the mainstream of wet electrophotography using liquid toner, in which a liquid toner image formed on a photoconductor is directly transferred to a recording medium (recording paper) by means of an electric field.

However, the conventional direct electric field transfer system has such disadvantages as being likely to cause transfer unevenness due to electric field variations according to unevenness in the surface of a recording medium (recording paper) and to cause transfer failure due to variations in electrical properties and the environment dependency of the recording medium (recording paper). Thus the conventional direct electric field transfer system significantly lowers the quality of transferred images. The conventional direct electric field transfer system requires a given amount of solvent interposed between a latent image carrier and a recording medium (recording paper) so that charged toner particles electrophoretically migrate in the solvent in a known manner to be transferred to the recording medium (recording paper). As a result, a large amount of solvent adheres to the recording medium (recording paper) after transfer. The adhering solvent partially evaporates in a heat fusing process and is discharged outside the image forming apparatus. This causes such a problem of adversely affecting the human body through inhalation of the effluvium or vapor.

In order to overcome the defects of the direct electric field transfer system, provided is an indirect transfer system using an intermediate transfer medium. In a known example of the indirect transfer system, an image of toner particles is transferred from a latent image carrier to an intermediate transfer medium under an electric field, and then is transferred to a recording medium (recording paper) by means of pressure (and heat). Another example of the indirect transfer system uses pressure (and heat) for both the transfer of an image of toner particles to an intermediate transfer medium and the transfer of the image of toner particles to a recording medium (recording paper), without using electric fields.

Either of the examples uses pressure to transfer an image of toner particles dried to a recording medium (recording paper) avoiding adhesion of solvent to the recording medium (recording paper), and thereby highly efficiently transferring the image of toner particles to the recording medium (recording paper). Those examples can adjust pressure to transfer images of toner particles to various kinds of record media (recording papers), being advantageously versatile in paper.

The conventional indirect transfer system of transferring images of toner particles to a recording medium (recording paper) by means of pressure, generally uses a rubber material having elasticity for an intermediate transfer medium. The surface of the intermediate transfer medium thus has some degree of adhesion. This can cause the recording medium (recording paper) to adhere to and entangled with the intermediate transfer medium during the transfer of images of toner particles from the intermediate transfer medium to the recording medium (recording paper) in the conventional indirect transfer system.

In such a state, even with a separating claw or the like used to detach a recording medium (recording paper) from the intermediate transfer medium, strong adhesion of a certain kind of record medium (recording paper) to the intermediate transfer medium causes difficulty in detachment, leading to breakage of the recording medium (recording paper) even detached. A recording medium (recording paper) with a highly smooth surface especially has strong adhesion to the intermediate transfer medium, resulting in difficulty in paper feeding.

To deal with this, a recording medium (recording paper) may be chucked with another mechanism in advance to prevent entanglement with the intermediate transfer medium. This, however, disadvantageously complicates the mechanism.

BRIEF SUMMARY OF THE INVENTION

The present invention has been made in view of the above problems, and has an object of providing an image forming apparatus configured to facilitate detachment of any kind of recording medium (recording paper) from an intermediate transfer medium, having improved versatility in paper.

In order to attain the above object, according to a first aspect of the present invention, there is provided an image forming apparatus which comprises: an image carrier configured to carry an image formed with toner particles; a feeding mechanism configured to feed a recording medium; and an intermediate transfer medium comprising a first area to which the image on a surface of the image carrier is transferred and a second area having adhesion lower than that of the first area, the intermediate transfer medium being configured to transfer the image transferred to the first area to the recording medium.

According to a second aspect of the present invention, there is provided an image forming apparatus which comprises: an image carrier configured to carry an image formed with toner particles; a feeding mechanism configured to feed a recording medium; an intermediate transfer medium configured to transfer the image transferred from a surface of the image carrier thereto to the recording medium fed by the feeding mechanism; a release area forming mechanism configured to form a release area having adhesion lower than that of the surface of the intermediate transfer medium at a portion of the intermediate transfer medium to which the front end of the recording medium is fed; and a release area removing mechanism configured to remove the release area.

DETAILED DESCRIPTION OF THE INVENTION

Figure 1:
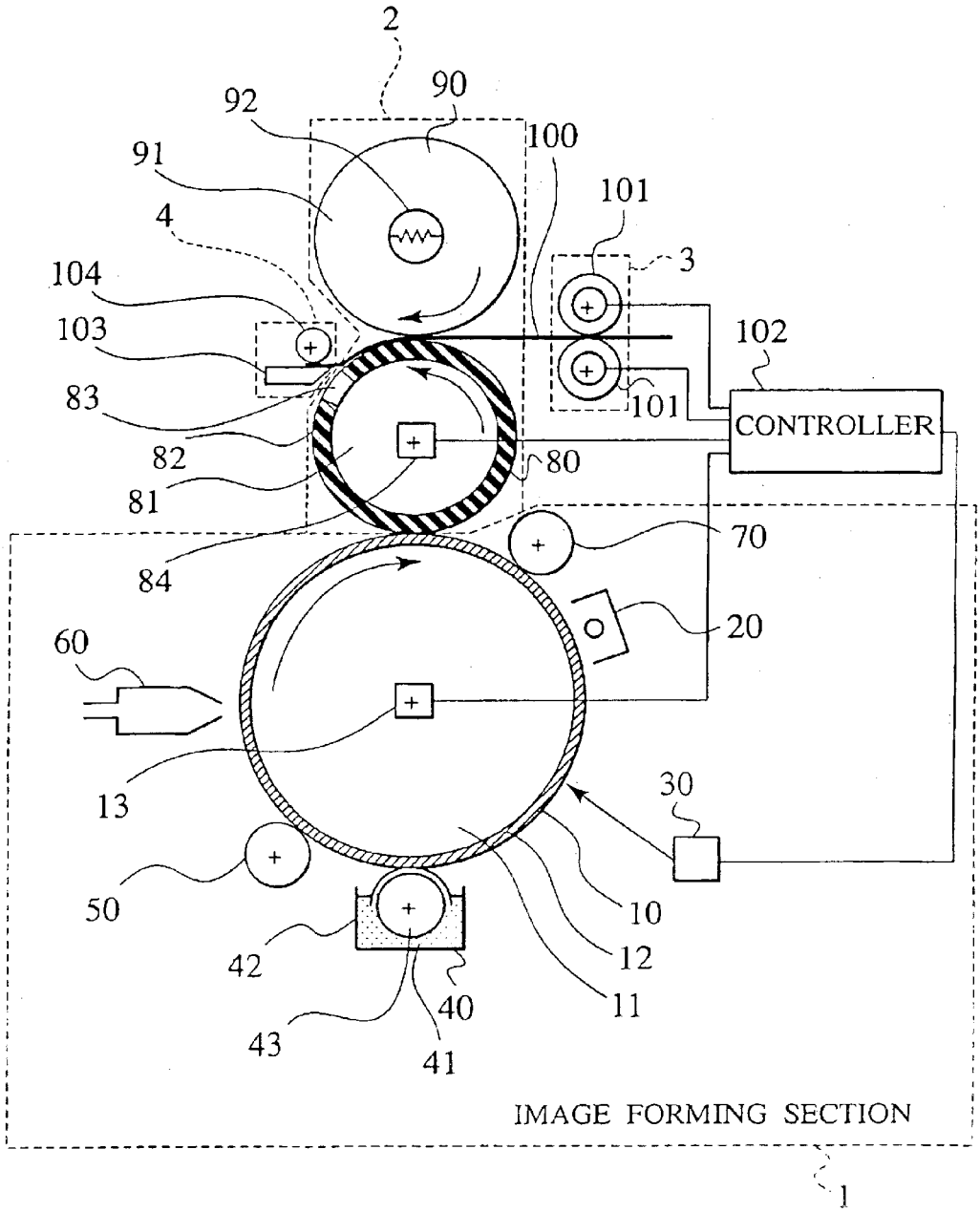
FIG. 1 is a schematic diagram of an image forming apparatus according to an embodiment of the present invention.

Various embodiments of the present invention will be described with reference to the accompanying drawings. It is to be noted that the same or similar reference numerals are applied to the same or similar parts and elements throughout the drawings, and the description of the same or similar parts and elements will be omitted or simplified.

Generally and as it is conventional in the representation of devices, it will be appreciated that the various drawings are not drawn to scale from one figure to another nor inside a given figure.

In the following descriptions, numerous specific details are set forth to provide a through understanding of the present invention. However, it will be obvious to those skilled in the art that the present invention may be practiced without such specific details.

Configuration of Image Forming Apparatus in Embodiment 1

A first embodiment of the present invention will be described with reference to FIG. 1. FIG. 1 is a schematic diagram of an image forming apparatus according to this embodiment.

The image forming apparatus of the first embodiment forms images using an indirect transfer system in wet electrophotography using liquid toner. Specifically, as shown in FIG. 1, the image forming apparatus includes an image forming section 1, an image transferring section 2, a feeding mechanism 3, a separating mechanism 4, and a controller 102.

The image forming section 1 uses conventional wet electrophotography to form an image (liquid toner image) to be transferred to a recording medium (recording paper), on an image carrier such as a photosensitive drum 10. More specifically, as shown in FIG. 1, the image forming section 1 includes the photosensitive drum 10, a charging device 20, an exposure device 30, a developing device 40, a squeezing device 50, a drying device 60, and a cleaning device 70. Each component can utilize conventional techniques without modification.

The photosensitive drum 10 has a metal drum 11. A photosensitive layer 12 made from an inorganic or organic material is provided on the metal drum 11. A protective layer is preferably provided on the photosensitive layer 12. The photosensitive drum 10 rotates clockwise (in this embodiment) about a drive shaft. The photosensitive drum 10 constitutes an image carrier retaining an image formed thereon to be transferred to a recording medium (recording paper).

A rotary encoder 13 is provided at the drive shaft of the photosensitive drum 10. The rotary encoder 13 detects the rotational position of the photosensitive drum 10.

The charging device 20 is provided around the photosensitive drum 10 to uniformly charge the photosensitive drum 10. The charging device 20 is, for example, in the form of a charger with a corotron or scorotron wire, or a solid ion generator.

The exposure device 30 is provided around the photosensitive drum 10 to perform exposure for image formation, that is, to irradiate charges on the photosensitive drum 10 in response to image forming signals, thereby forming an electrostatic latent image on the photosensitive layer 12 of the photosensitive drum 10. The exposure device 30 is, for example, in the form of a laser optical system using beam scanning or a solid head such as an LED head.

The developing device 40 is provided around the photosensitive drum 10, feeding liquid toner 41 to form a liquid toner image on the photosensitive layer 12 of the photosensitive drum 10, thereby visualizing the electrostatic latent image formed on the photosensitive layer 12 of the photosensitive drum 10.

Specifically, the developing device 40 includes the liquid toner 41, a liquid toner container 42, and a developing roller 43. The liquid toner 41 is, for example, a liquid developer with toner particles containing pigments dispersed in an insulative hydrocarbon solvent. The liquid toner container 42 holds the liquid toner 41. The developing roller 43 supplies the liquid toner 41 to the surface of the photosensitive drum 10 to visualize the electrostatic latent image through electrophoretic migration of toner particles by means of an electric field created between the developing roller 43 and the electrostatic latent image upon application of developing bias.

The squeezing device 50 is provided around the photosensitive drum 10 to remove excess solvent from the liquid toner image (image formed with toner particles in the solvent) formed on the photosensitive layer 12 of the photosensitive drum 10. The squeezing device 50 has a roller provided with a clearance from the surface of the photosensitive drum 10 and rotates in a direction (counterclockwise in this embodiment) opposite to the moving direction of the surface of the photosensitive drum 10.

The drying device 60 is provided around the photosensitive drum 10 to dry the squeezed liquid toner image, further reducing the amount of solvent in the liquid toner image. Here the dried liquid toner image is referred to as a "dried toner image." The drying device 60 supplies airflow to the surface of the photosensitive drum 10.

The cleaning device 70 collects a residual dried toner image left on the photosensitive drum 10. The cleaning device 70 is, for example, in the form of a driving roller with a web wound thereon.

The image transferring section 2 transfers the dried toner image formed on the photosensitive drum 10 to the intermediate transfer roller 80 and then transfers the dried toner image transferred to the intermediate transfer roller 80 to the recording medium (recording paper). Specifically, the image transferring section 2 includes, as shown in FIG. 1, the intermediate transfer roller 80 and a backup roller 90.

The intermediate transfer roller 80 is an intermediate transfer medium which rotates around a drive shaft (counterclockwise in this embodiment) and temporarily retains an image (dried toner image) to be transferred from the photosensitive drum 10 to the recording medium (recording paper). The intermediate roller 80 has a metal roller 81. An elastic layer 82 made from elastic material such as silicon rubber or polyurethane rubber, for example, is provided on the metal roller 81.

Figure 2:
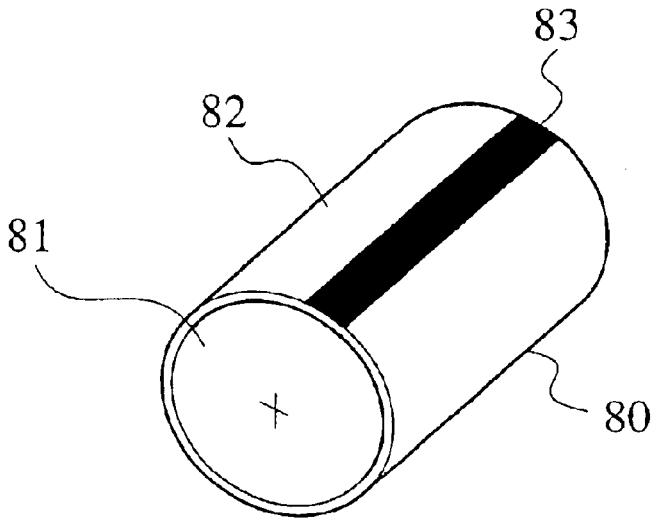
FIG. 2 is a schematic diagram of an intermediate transfer roller according to the embodiment of the present invention.

As shown in FIG. 2, the elastic layer 82 of the intermediate transfer roller 80 has a surface portion having been processed to form a release area (second area) 83 of a predetermined width extending in the longitudinal direction of the intermediate transfer roller 80. The release area 83 has lower adhesion than the other unprocessed area.

Figure 3:
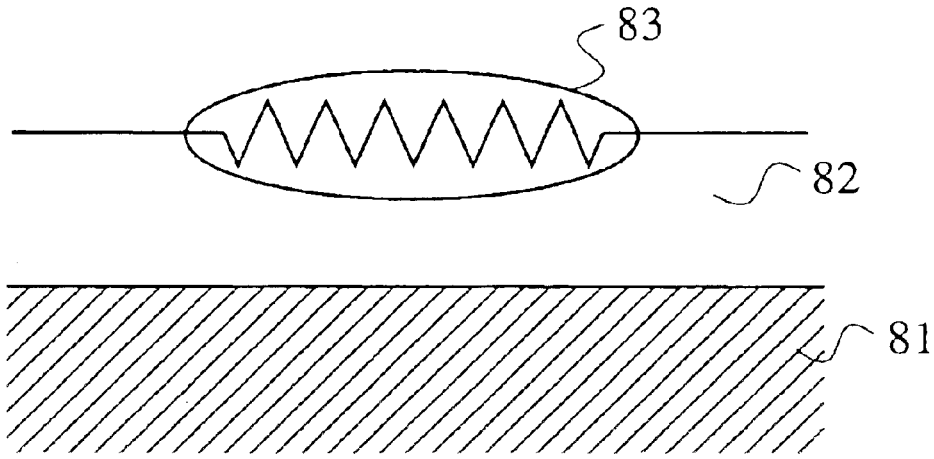
FIG. 3 is a diagram illustrating a release area formed on an elastic layer of the intermediate transfer roller according to the embodiment of the present invention.

An elastic material constituting the elastic layer 82 has a highly smooth surface so as to improve the transfer performance from the photoconductor, and thus has high adhesion to the recording medium such as a fed paper. The release area 83 on the elastic layer 82 having different surface roughness through the formation of minute projections and depressions as shown in FIG. 3, for example, has a smaller contact area with respect to an object brought into contact with the elastic material constituting the elastic layer 82, thus having reduced adhesion.

Thus the adhesion of the elastic material in the release area 83 of the elastic layer 82 is reduced as compared with the adhesion of the elastic material in the other area of the elastic layer 82 having surface roughness not changed as described above. The release area 83 is formed by a process of roughing a surface of the elastic layer 82 after forming the elastic layer 82 on the metal roller 81.

The release area 82 may be formed by a process of scraping a surface of the elastic layer 82, changing the surface roughness from normal (about 3 microns) to about 20 to 80 microns by sandblasting, for example. The release area 82 may also be formed by a process of hollowing out a portion of the elastic layer 82.

Figure 4A:
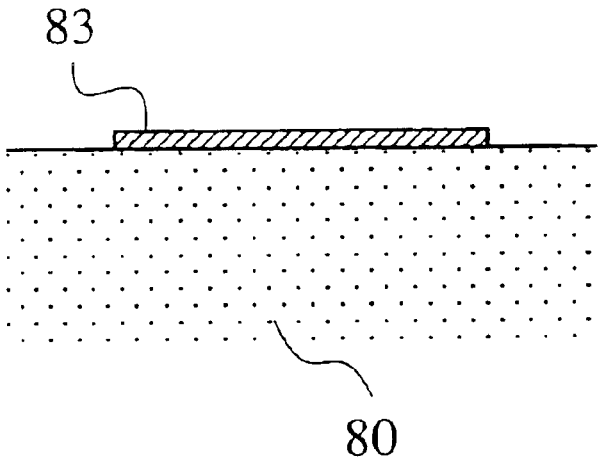
FIGS. 4A and 4B are diagrams illustrating the release area formed on the elastic layer of the intermediate transfer roller according to the embodiment of the present invention.

Material of high hardness has less adhesion than that of material of low hardness. Thus the release area 83 may be formed by a process of applying (attaching) a material of high hardness, that is, a material of low adhesion to the surface of the elastic layer 82, after forming the elastic layer 82 on the metal roller 81. The release area 83 may be formed, as shown in FIG. 4(A), by a process of applying a low adhesion material 83*a* such as a silicon material of high hardness (95 degrees, for example) (to a thickness of about 10 to 20 microns). The hardness of a silicon material used as an elastic material is usually about 50 degrees.

Figure 4B:
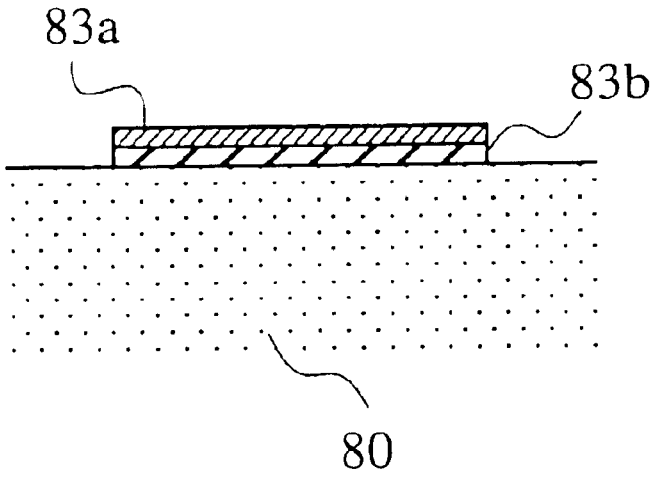

The release area 83 may be formed, as shown in FIG. 4(B), through a process of applying a low adhesion material 83*a* (Teflon material, for example) which is difficult to directly apply to a surface of the elastic layer 82, via a primer 83*b* to a surface of the elastic layer 82 (to a thickness of about 10 to 20 microns). Here the applied material is not limited to material of high hardness, and can be any if having low adhesion.

The intermediate transfer roller 80 preferably has a heater (heating source) such as a halogen heater inside. The rotary encoder 84 is provided at the drive shaft of the intermediate transfer roller 80. The rotary encoder 84 detects the position of the release area 83. In place of the rotary encoder 84, an external sensor may be provided to detect the position of a marker provided at a portion of the intermediate transfer roller 80. The release area 83 is provided for preventing the adhesion of a recording medium to the elastic layer 82 of the intermediate transfer roller 80 as will be described later, and thus has substantially reduced function of transferring images. It is therefore necessary to set the circumference of the intermediate transfer roller 80 except the release area 83 equal to or greater than the length of an image to be transferred (recorded) to the recording medium (recording paper) so that the image is transferred onto the area other than the release area 83.

The backup roller 90 rotates clockwise (in this embodiment) around a drive shaft and provides the influence of pressure and heat to the intermediate transfer roller 80 when a dried toner image retained on the intermediate transfer roller 80 is transferred to a recording medium 100. The backup roller 90 has a metal roller 91 and preferably has an elastic layer of low adhesion or low friction properties provided on the surface of the metal roller 91. The backup roller 90 has a heater 92 inside.

The feeding mechanism 3 is provided in the vicinity of the image transferring section 2 for feeding the recording medium 100 between the intermediate transfer roller 80 and the backup roller 90, that is, to the image transferring section 2. The feeding mechanism 3 includes at least two paper feed rollers 101.

The separating mechanism 4 is provided in the vicinity of the image transferring section 2 for detaching the recording medium 100 adhering to the intermediate transfer roller 80 and ejecting the detached recording medium 100 outside the image forming apparatus. The separating mechanism 4 has a guide 103 and a conveying roller 104. The guide 103 guides the recording medium 100 toward the exit.

The controller 102 controls the operation of the image forming apparatus according to the present embodiment based on information detected by the rotary encoders 13, 84.

Specifically, the controller 102 controls the exposure timing of the exposure device 30 based on the rotational position of the intermediate transfer roller 80 detected by the rotary encoder 84.

Here a distance between the exposed position with the exposure device 30 and the transfer position (the contact position between the photosensitive drum 10 and the intermediate transfer roller 80) on the photosensitive drum 10 is designated as L1. A distance between the front end of an image and the release area 83 is designated as L2. The numerical variations in output of the encoder 84 corresponding to L1, L2 are designated as D1, D2, respectively.

The position indicated by the encoder 84 when the release area 83 is in the transfer position is designated as P1. The controller 102 previously stores the position where the output of the encoder 84 is P1−(D1+D2) as an exposure starting position P2 for the exposure device 30. When P2<0, $P2=P1+P_{max}\times n-(D1+D2)$, in which $P_{max}$ is a maximum output value of the encoder 84 (255 in 8 bits, for example) and n is a minimum integer satisfying $n>=(|P2|/P_{max})$.

When the output of the encoder 84 is the exposure starting position P2 set as described above, the exposure device 30 starts exposure so that the release area 83 is brought into contact with the photosensitive drum 10 at the transfer position, being distanced by L2 from the front end of the image.

Operation of Image Forming Apparatus in Embodiment 1

Figure 5:
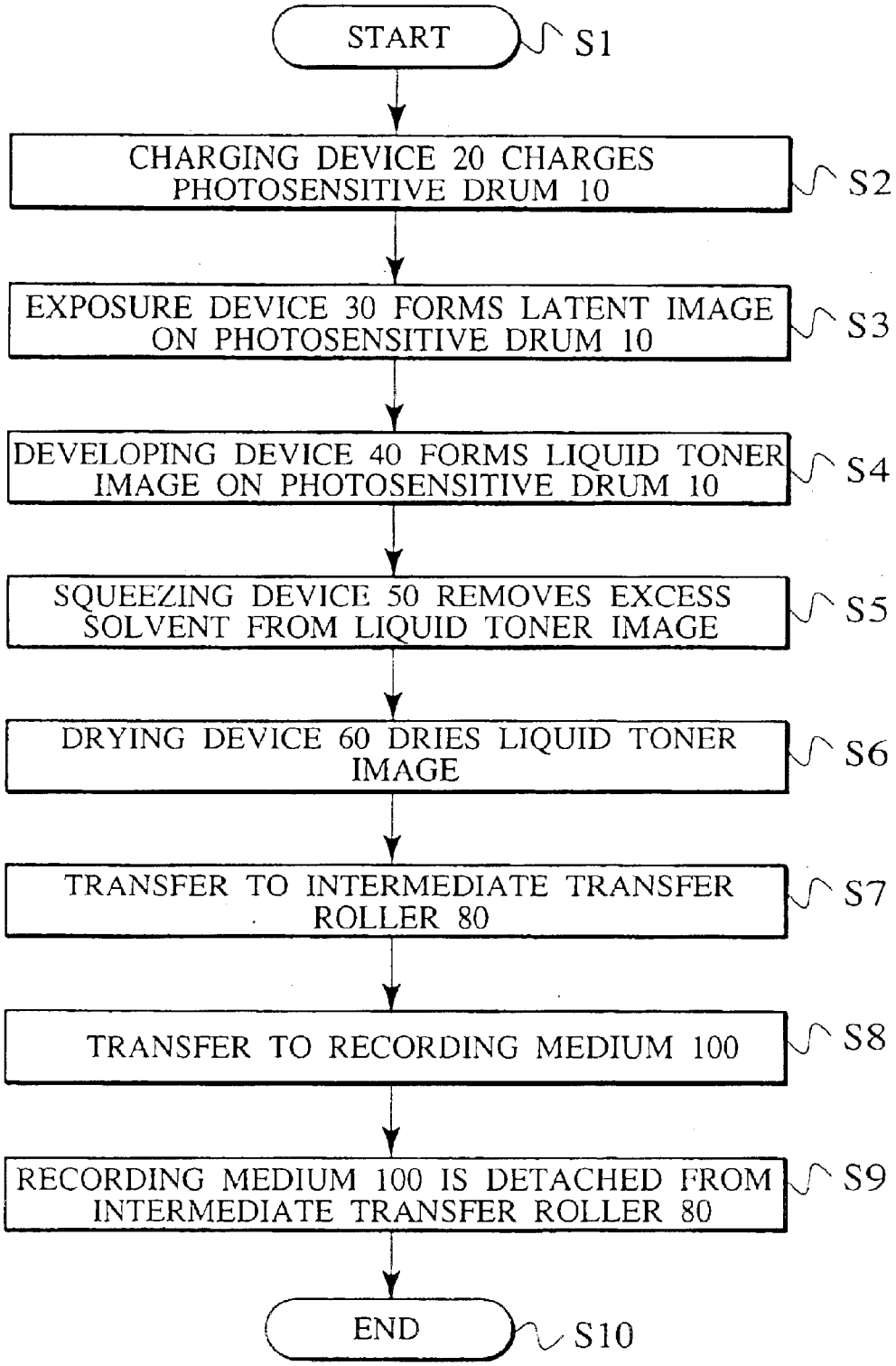
FIG. 5 is a flow chart illustrating the operation of the image forming apparatus according to the embodiment of the present invention.

The operation of the image forming apparatus according to this embodiment will be described with reference to FIG. 5. FIG. 5 is a flow chart illustrating the operation of the image forming apparatus in this embodiment.

As shown in FIG. 5, at step S1, the photosensitive drum 10 in the image forming section 1 starts its clockwise rotation and the intermediate transfer roller 80 starts its counterclockwise rotation. At step S2, the charging device 20 in the image forming section 1 uniformly charges the photosensitive drum 10. At step S3, the exposure device 30 in the image forming section 1 forms an electrostatic latent image showing an image to be recorded on the recording medium 100 on the photosensitive layer 12 of the rotating photosensitive drum 10 in accordance with directions from the controller 102. Here the operation timing of the exposure device 30 is controlled so as to satisfy the timing conditions for image transfer at step S7 to be described later. That is, when the output of the encoder 84 of the intermediate transfer roller 80 is p2, the exposure device 30 starts exposure.

At step S4, the developing device 40 in the image forming section 1 supplies the liquid toner 41 to visualize the electrostatic latent image formed on the photosensitive layer 12 of the rotating photosensitive drum 10, forming a liquid toner image on the photosensitive layer 12 of the photosensitive drum 10. At step S5, the squeezing device 50 in the image forming section 1 removes excess solvent from the liquid toner image formed on the photosensitive layer 12 of the rotating photosensitive drum 10. At step S6, the drying device 60 in the image forming section 1 dries the squeezed liquid toner image, further reducing the amount of solvent in the liquid toner image, and thereby forming a dried toner image on the photosensitive drum 10. The above steps S1 to S6 constitute a process performed by the image forming section 1.

At step S7, the dried toner image formed on the photosensitive drum 10 is transferred to a surface of the intermediate transfer roller 80 in an area of a nip formed between the contact portions of the photosensitive drum 10 and the intermediate transfer roller 80 under the influence of pressure. During the operation, the positional relationship between an area formed with an image (dried toner image) on the photosensitive drum 10 (image formed area) and the release area (second area) 83 formed on the elastic layer 82 of the intermediate transfer roller 80 is adjusted so that the release area 83 on the intermediate transfer roller 80 is put on an area rotationally ahead of the image formed area on the photosensitive drum 10. This is performed by the controller 102 monitoring the position of the release area 83 formed on the elastic layer 82 of the intermediate transfer roller 80 using the output of the rotary encoder 84 as described above and based on the positional information obtained, causing the exposure device 30 to form at step S3 an electrostatic latent image at an appropriate position on the photosensitive drum 10. A residual dried toner image left on the photosensitive drum 10 without being transferred to a surface of the intermediate transfer roller 80 is removed by the cleaning device 70 in the image forming section 1.

At step S8, the dried toner image transferred onto the intermediate transfer roller 80 is transferred on the recording medium 100 fed by the paper feed rollers 101 under the influence of pressure and heat from the backup roller 90. During the transfer, the controller 102 controls the paper feed roller 101 based on information from the rotary encoder 84 in a manner that the frond end portion of the recording medium 100 is brought into contact with the release area 83 formed on the elastic layer 82 of the intermediate transfer roller 80. The rotation of the paper feed rollers 101 thus controlled advances the recording medium 100 to the transfer position in the image transferring section 2.

At step S9, after receiving the dried toner image from the intermediate transfer roller 80, the recording medium 100 is guided to the conveying roller 104 by the guide 103 of the separating mechanism 4 and is conveyed toward the exit by the rotation of the conveying roller 104. Even when the recording medium 100 adheres to the surface of the elastic layer 82 of the intermediate transfer roller 80, the front end of the recording medium 100, when released from the pressure by the backup roller 90, is easily detached from the surface of the elastic layer 82 of the intermediate transfer roller 80 because being positioned on the release area 83.

The rotational length of the intermediate transfer roller 80 at the release area 83 is set in a manner that the front end portion of the recording medium 100 is brought into contact with the conveying roller 103 before the trailing end of the release area 83 reaches the guide 103. This facilitates the detachment of the recording medium 100 even contacting and adhering to a portion following the release area 83 because the front end portion of the recording medium 100 is already in contact with the conveying roller 104.

At step S10, the operation of forming the image on the recording medium 100 using the image forming apparatus according to this embodiment is completed.

Function/Effect of Image Forming Apparatus in Embodiment 1

According to the image forming apparatus of this embodiment, a portion of the surface of the intermediate transfer roller 80 is reduced in adhesion to form the release area 83 and the front end portion of the recording medium 100 is brought into contact with the release area 83 by control, so that the front end of the recording medium 100 is securely detached from the intermediate transfer roller 80, facilitating the detachment of the recording medium 100 from the image transfer section 2 even when the recording medium 100 has high smoothness.

The present embodiment illustrates that the exposure start timing of the exposure device 30 is determined by the encoder 84 connected to the drive shaft of the intermediate transfer roller 80. The present invention is not limited thereto. For example, a mark for positional detection of the release area 83 may be provided at a specific location on the surface of the intermediate transfer roller 80 so that a sensor detects the mark to detect the position of the release area 83, and transmits the positional information to the controller 102 for determination of exposure start timing of the exposure device 30.

In this case, with the time taken for the photosensitive drum 10 to move from the exposure position to the transfer position as T1 and the time that has elapsed since the photosensitive drum 10 contacted the release area 83 before the image front end position on the photosensitive drum 10 reaches the transfer position as T2, it is only necessary to detect position P3 of the release area 83 on the intermediate transfer roller 80 at a time going back by (T1–T2) from the time when the release area 83 reaches the transfer position. For example, a mark is put on the release area 83 and a sensor is provided at position P3. The exposure device 30 starts exposure at the instance at which the sensor detects the mark, so that the release area 83 reaches the transfer position at a time earlier by T2 than the time when the front end of the image reaches the transfer position. The sensor does not necessarily need to be provided at position P3 and may be provided at a desired position on the intermediate transfer roller 80 with the knowledge of the time difference from the position P3.

Configuration of Image Forming Apparatus in Embodiment 2

Figure 6:
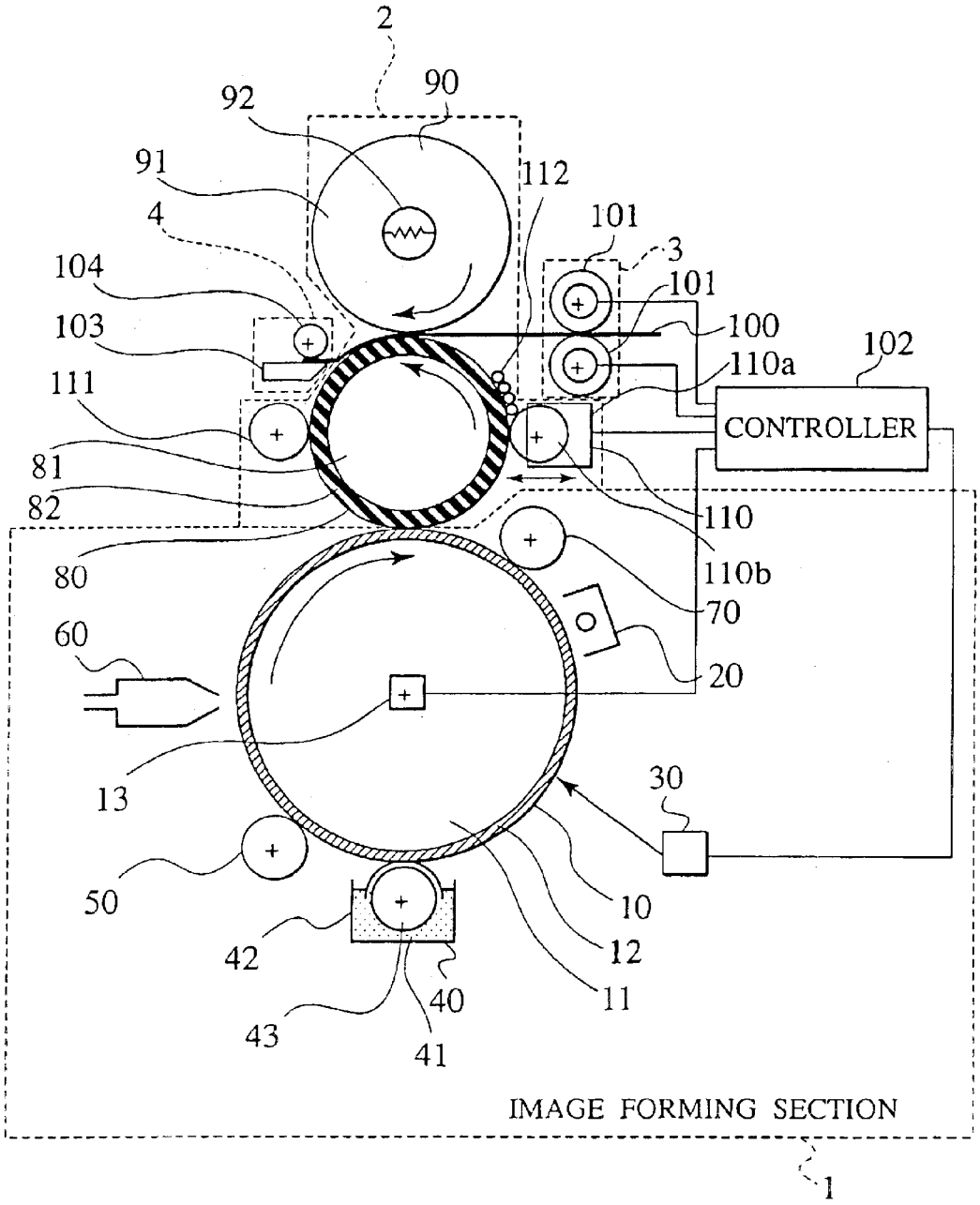
FIG. 6 is a schematic diagram of an image forming apparatus according to another embodiment of the present invention.

A second embodiment of the present invention will be described with reference to FIG. 6. FIG. 6 is a schematic diagram illustrating an image forming apparatus according to this embodiment.

The image forming apparatus of this embodiment forms images by an indirect transfer system in wet electrophotography using liquid toner, as the image forming apparatus of the first embodiment. Specifically, as shown in FIG. 6, the image forming apparatus includes an image forming section 1, an image transferring section 2, a paper feed mechanism 3, a separating mechanism 4, and a controller 102. The image forming apparatus of this embodiment is different from the image forming apparatus of the first embodiment in the process of forming a release area 83. Only the difference of the image forming apparatus of this embodiment from the image forming apparatus of the first embodiment will be described below.

The image transferring section 2 of the image forming apparatus according to this embodiment includes, as shown in FIG. 6, a release area forming mechanism 110 and a release area removing mechanism ill in addition to an intermediate transfer roller 80 and a backup roller 90 constituting the image transferring section 2 of the image forming apparatus in the first embodiment. The release area 83 is not previously formed on the elastic layer 82 of the intermediate transfer roller 80 of the image forming apparatus of this embodiment, unlike the image forming apparatus of the first embodiment.

The release area forming mechanism 110 is provided upstream of a contact position between the intermediate transfer roller 80 and the backup roller 90 and downstream of a contact position between the intermediate transfer roller 80 and the photosensitive drum 10, for forming a release area 83 on demand on the surface of the elastic layer 82 of the intermediate transfer roller 80.

More specifically, the release area forming mechanism 110 forms the release area 83 in a manner that the head portion of a recording medium 100 is positioned on the release area 83 prior to the transfer of an image (dried toner image) transferred on the elastic layer 82 of the intermediate transfer roller 80 to the recording medium 100.

The controller 102 controls the timing of formation of the release area 83 by the release area forming mechanism 110 based on the rotational position of the photosensitive drum 10.

For example, the controller 102 stores an output value (P4) of an encoder 13 when a portion to be formed with the release area 83 on the intermediate transfer roller 80 reaches the release area forming position of the release area forming mechanism 110 after the start of exposure by the exposure device 30. When the encoder 13 indicates P4, the controller 102 causes the release area forming mechanism 110 to operate, forming the release area 83 at an appropriate position on the intermediate transfer roller 80.

Also available is a method not utilizing the output of the encoder 13. In such a method, the release area forming mechanism 110 is operated when a predetermined time has elapsed since the start of exposure by the exposure device 30, for example. Specifically, with a time taken for a portion of the photosensitive drum 10 to pass the exposure position of the exposure device 30 and reach the transfer position as T3, and with a time taken for a portion of the intermediate transfer roller 80 to pass the transfer position and reach the forming position of the release area 83 as T4, and a travel time corresponding to the distance between the position of the release area 83 on the intermediate transfer roller 80 and the front end of the image as T5, the release area forming mechanism 110 is controlled to operate after the lapse of time (T3+T4−T5) since the start of exposure by the exposure device 30. This method also forms the release area 83 at an appropriate position.

More specifically, the release area forming mechanism 110 includes a low adhesion material container 110*a*, a feed roller 110*b* and a low adhesion material 112.

The low adhesion material container 111*a* contains the low adhesion material 112. The low adhesion material container 110*a* has a control mechanism (not shown) which makes the release area forming mechanism 110 into contact with or distanced from the elastic layer 82 of the intermediate transfer roller 80. This control mechanism is connected to the controller 102 and is controlled by the controller 102.

The feed roller 110*b* supplies the low adhesion material 112 onto the elastic layer 82 of the intermediate transfer roller 80, that is, applies fine particles of the low adhesion material 112 to the surface of the elastic layer 82 of the intermediate transfer roller 80.

The low adhesion material 112 is held in the low adhesion material container 110*a* and is applied to the surface of the elastic layer 82 of the intermediate transfer roller 80 by the feed roller 112*b* to form the release area 83 on the elastic layer 82 of the intermediate transfer roller 80. The low adhesion material 112 contains fine particles of about 5 to 200 microns. The fine particles are dispersed on a surface of the elastic layer 82 of the intermediate transfer roller 80 to reduce the smoothness of the surface of the elastic layer 82, and thereby reducing the adhesion of the surface of the elastic layer 82. As the fine particles, particles of metal oxide such as silica, alumina and titania, acryl particles such as PMMA particles, and silicon, polyurethane, nylon, olefin and Teflon particles are available.

For feeding the low adhesion material 112 to the elastic layer 82 of the intermediate transfer roller 80, techniques similar to those of feeding toner particles in a developing device utilizing electrophotography are useful, for example. Specifically, conceivable are a method of forming a thin layer using the low adhesion material 112 frictionally charged on the feed roller 110*b*, or a method of creating a condition similar to that of binary toner particles through mixing magnetic particles with the low adhesion material 112 using the feed roller 110*b* made from a magnetic material.

The release area removing mechanism 111 is provided on the intermediate transfer roller 80 at a position downstream of the guide 103 and upstream of the contact position between the intermediate transfer roller 80 and the photosensitive drum 10, for removing the low adhesion material 112 on the elastic layer 82 of the intermediate transfer roller 80. Thus the release area removing mechanism 111 restores the release area 83 to the original condition after at least the front end of the recording medium 100 is brought into contact with the conveying roller 104. The release area removing mechanism 111 presses a roller or a belt having adhesion onto the surface of the elastic layer 82, for example.

Other components of the image forming apparatus of this embodiment are identical to those of the image forming apparatus of the first embodiment.

Operation of Image Forming Apparatus in Embodiment 2

The operation of the image forming apparatus according to this embodiment is identical to that of the image forming apparatus of the first embodiment except for the following.

In the operation of the image forming apparatus of this embodiment, between the above-described steps S7 and S8, the controller 102 controls the low adhesion material container 110*a* of the release area forming mechanism 110 based on information from the rotary encoder 13 to press the feed roller 110*b* of the release area forming mechanism 110 for a predetermined time period against the surface of the elastic layer 82 of the intermediate transfer roller 80 at a position downstream of a portion formed with a dried toner image of the elastic layer 82 of the intermediate transfer roller 80, applying the low adhesion material 112 to the elastic layer 82 of the intermediate transfer roller 80, and thereby forming the release area 83. After step S9, the release area removing mechanism 111 removes the low adhesion material 112 left on the elastic layer 82 of the intermediate transfer roller 80.

Function/Effect of Image Forming Apparatus in Embodiment 2

According to the image forming apparatus of this embodiment, the release area forming mechanism 110 forms on demand the release area 83 on a portion of the elastic layer 82 in a manner that the head portion of the recording medium 100 is positioned on the release area 83 prior to the transfer of an image transferred to the elastic layer 82 onto the recording medium 100. This eliminates the constraint that the circumference of the intermediate transfer roller 80 should be greater than the length of the recording medium 100, leading to reduction in size of the apparatus. Also, the release area 83 can be prevented from contacting the photoconductor. This eliminates the need for taking account for the influence to the photoconductor, resulting in increased choices of material for the low adhesion material 112. Further, the need for timing control for the intermediate transfer roller 80 and the recording medium 100 is eliminated.

Configuration of Image Forming Apparatus in Embodiment 3

Figure 7:
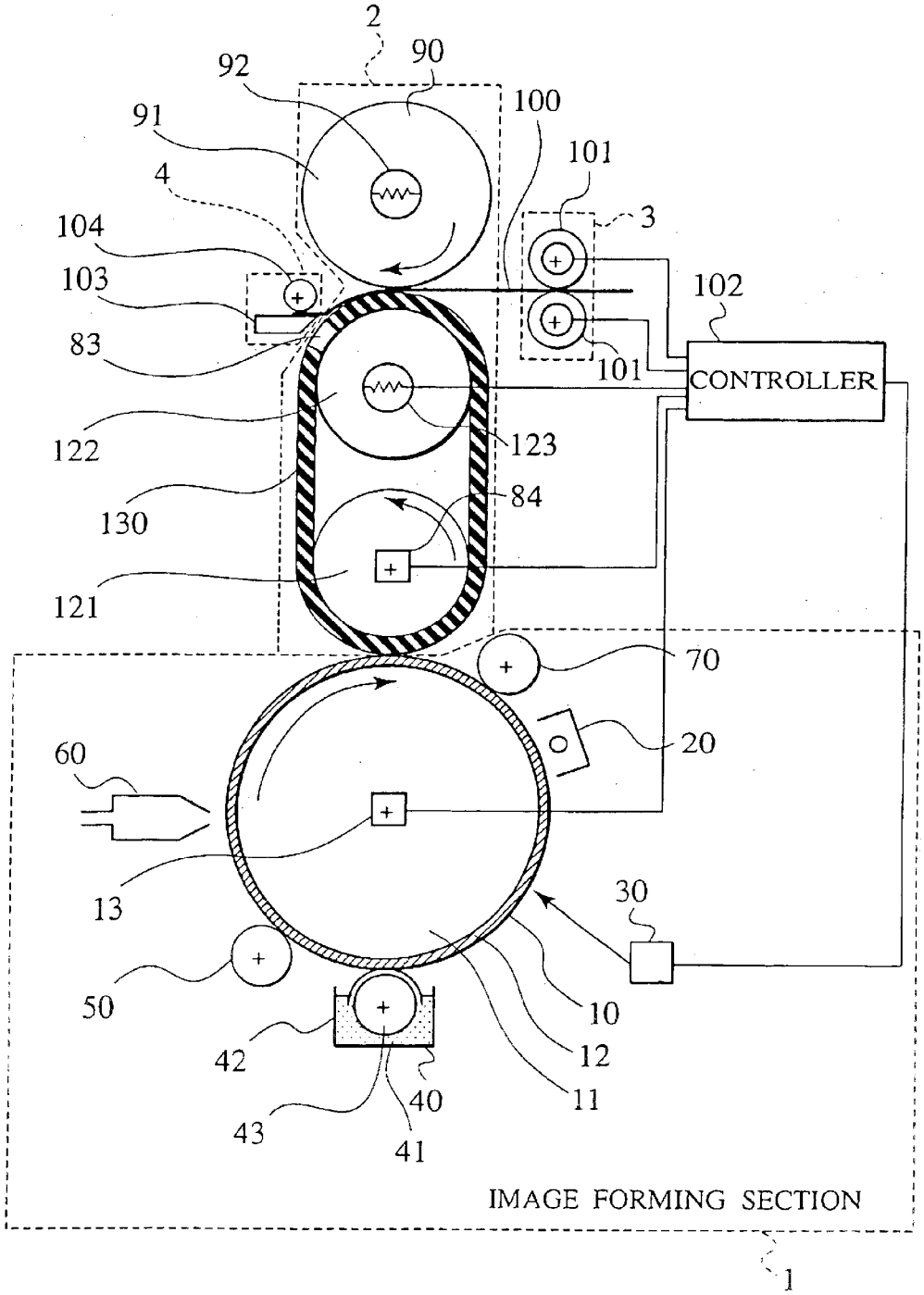
FIG. 7 is a schematic diagram of an image forming apparatus according to still another embodiment of the present invention.
Figure 8:
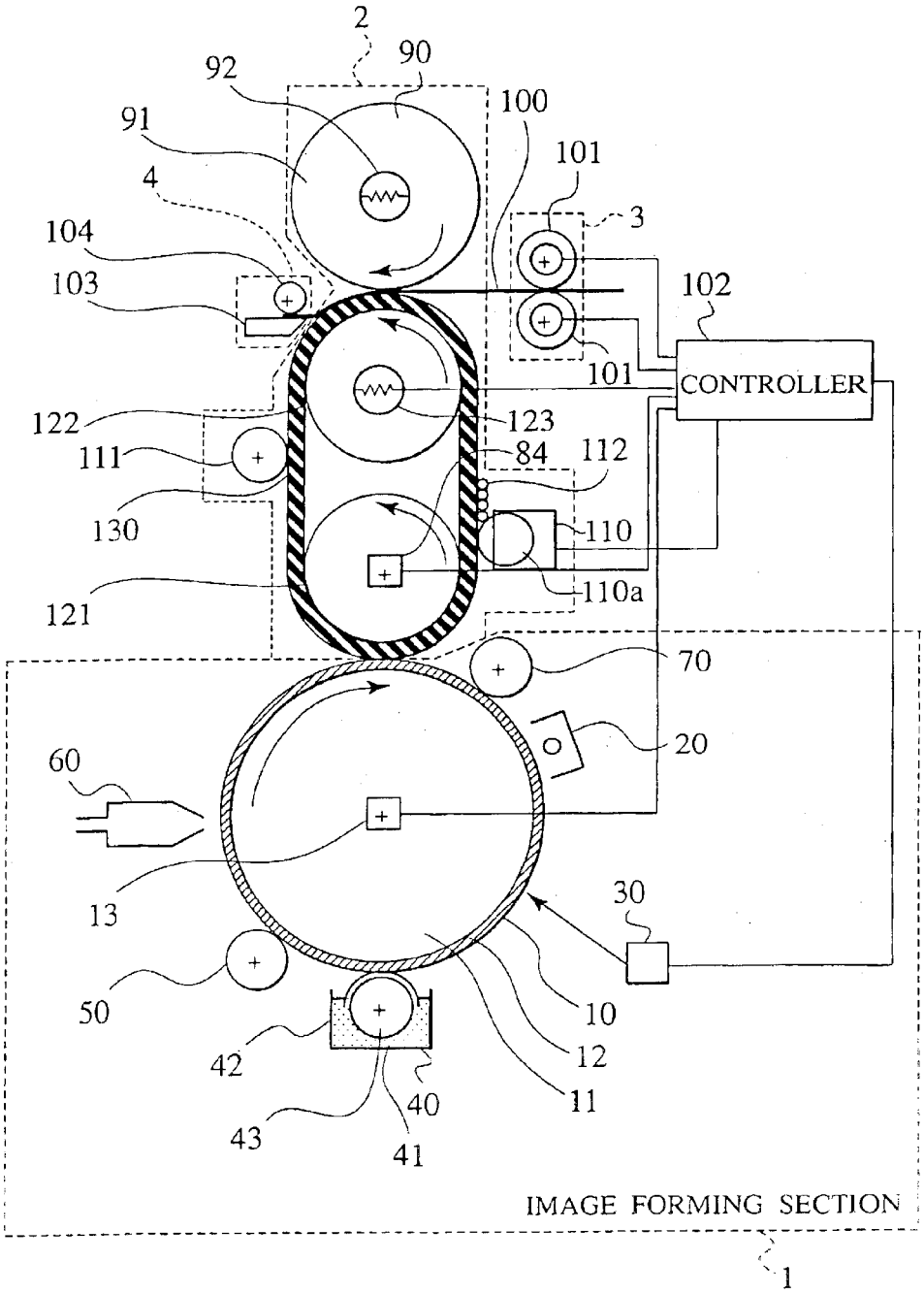
FIG. 8 is a schematic diagram of an image forming apparatus according to still another embodiment of the present invention.

A third embodiment of the present invention will be described with reference to FIGS. 7 and 8. FIGS. 7 and 8 are schematic diagrams illustrating an image forming apparatus of this embodiment.

The image forming apparatus of this embodiment forms images by an indirect transfer method in wet electrophotography using liquid toner, like the image forming apparatus of the first embodiment. Specifically, as shown in FIGS. 7 and 8, the image forming apparatus includes an image forming section 1, an image transferring section 2, a feeding mechanism 3, a separating mechanism 4, and a controller 102. The image forming apparatus of this embodiment is different from the image forming apparatus of the first embodiment in the configuration of the image transferring section 2. Only the difference of the image forming apparatus of this embodiment from the image forming apparatus of the first embodiment will be described.

The image transferring section 2 of the image forming apparatus of this embodiment has, as shown in FIG. 7, an intermediate transfer belt 130 and belt driving roller 121, 122. The image transferring section 2 of the image forming apparatus of this embodiment may further include a release area forming mechanism 110 and a release area removing mechanism 111 as shown in FIG. 8.

The intermediate transfer belt 130 is made from a material similar to that of the intermediate transfer medium of the first or second embodiment. The intermediate transfer belt 130 may be made only from an elastic material or may be configured to have least two layers with another elastic material of high hardness or metal as a base. The intermediate transfer belt 130 is in contact with the periphery of the two belt driving rollers 121, 122 and is supported and driven by the rollers.

The belt driving rollers 121, 122 are made from metal, for example. One of the rollers presses the intermediate transfer belt 130 against the photosensitive drum 11 and the other presses the intermediate transfer belt 130 against the backup roller 90 via a recording medium 100. The belt driving roller 121 has a rotary encoder 84 at a drive shaft. The controller 102 monitors the rotational position of the intermediate transfer belt 130 using the output of the rotary encoder 84. The belt driving roller 122 has a heater 123 inside.

The image forming apparatus of the first embodiment has the release area 83 formed on a portion of the surface of the elastic layer 82 of the intermediate transfer roller 80. The image forming apparatus of this embodiment instead has a release area 83 formed on a portion of the intermediate transfer belt 130 as shown in FIG. 7. The release area 83 may be formed in advance as in the image forming apparatus of the first embodiment (See FIG. 7), or may be formed on demand as in the image forming apparatus of the second embodiment (See FIG. 8).

Other components of the image forming apparatus of this embodiment are identical to those of the image forming apparatus of the first embodiment.

Operation of Image Forming Apparatus in Embodiment 3

The operation of the image forming apparatus of this embodiment is identical to that of the image forming apparatus of the first embodiment except for the following.

In the operation of the image forming apparatus of this embodiment, at step S7, a dried toner image formed on a photosensitive drum 10 is transferred to the surface of the intermediate transfer belt 130 under the influence of pressure in a nip area formed between the contact portions of the photosensitive drum 10 and the intermediate transfer belt 130. During the operation, the controller 102 controls the formation of the image at a predetermined position on the photosensitive drum 10 based on information from the rotary encoders 13, 84 so that the release area 83 formed on the intermediate transfer belt 130 is put on an area rotationally ahead of the area where the image (dried toner image) is formed on the photosensitive drum 10. At this step, the release area 83 formed on the intermediate transfer belt 130 is thus brought into contact with an area on the photosensitive drum 10 rotationally ahead of the area where the image is formed on the photosensitive drum 10. The residual dried toner image left on the photosensitive drum 10 without being transferred to the surface of the intermediate transfer belt 130 is removed by the cleaning device 70 of the image forming section 1.

At step S8, the dried toner image transferred onto the intermediate transfer belt 130 is transferred onto the recording medium 100 fed by paper feed rollers 101 of the feeding mechanism 3 under pressure and heat applied from the backup roller 90. During the transfer, the controller 102 controls the paper feed roller 101 based on information from the rotary encoder 84 so that the front end portion of the recording medium 100 is brought into contact with the release area 83 formed on the intermediate transfer belt 130. The rotation of the paper feed rollers 101 thus controlled advances the recording medium 100 to the transfer position in the image transferring section 2.

At step S9, after receiving the dried toner image from the intermediate transfer belt 130, the recording medium 100 is guided by a guide 103 of the separating mechanism 4 to a conveying roller 104, and is conveyed toward the exit by the rotation of the conveying roller 104. During the conveyance, even adhering to the surface of the intermediate transfer belt 130, the recording medium 100 is in contact with the release area 83 at its front end portion, so that the front end portion of the recording medium 100 is easily released from the surface of the intermediate transfer belt 130 when released from the pressure from the backup roller 90.

Here the rotational length of the intermediate transfer belt 130 at the release area 83 is set so that the front end portion of the recording medium 100 is brought into contact with the conveying roller 104 before the trailing end portion of the release area 83 reaches the guide 103. This facilitates the detachment of the recording medium 100 even when the recording medium 100 contacts and adheres to the portion following the release area 83 because the front end portion of the recording medium 100 is already in contact with the conveying roller 104.

Function/Effect of Image Forming Apparatus in Embodiment 3

According to the image forming apparatus of this embodiment, since the circumference of the intermediate transfer belt 130 determines the length of the recording medium 100 to be able to receive an image, the need for changing the diameter of the rollers constituting the intermediate transfer medium in accordance with the length of the recording medium 100 is eliminated.

Configuration of Image Forming Apparatus in Embodiment 4

Figure 9:
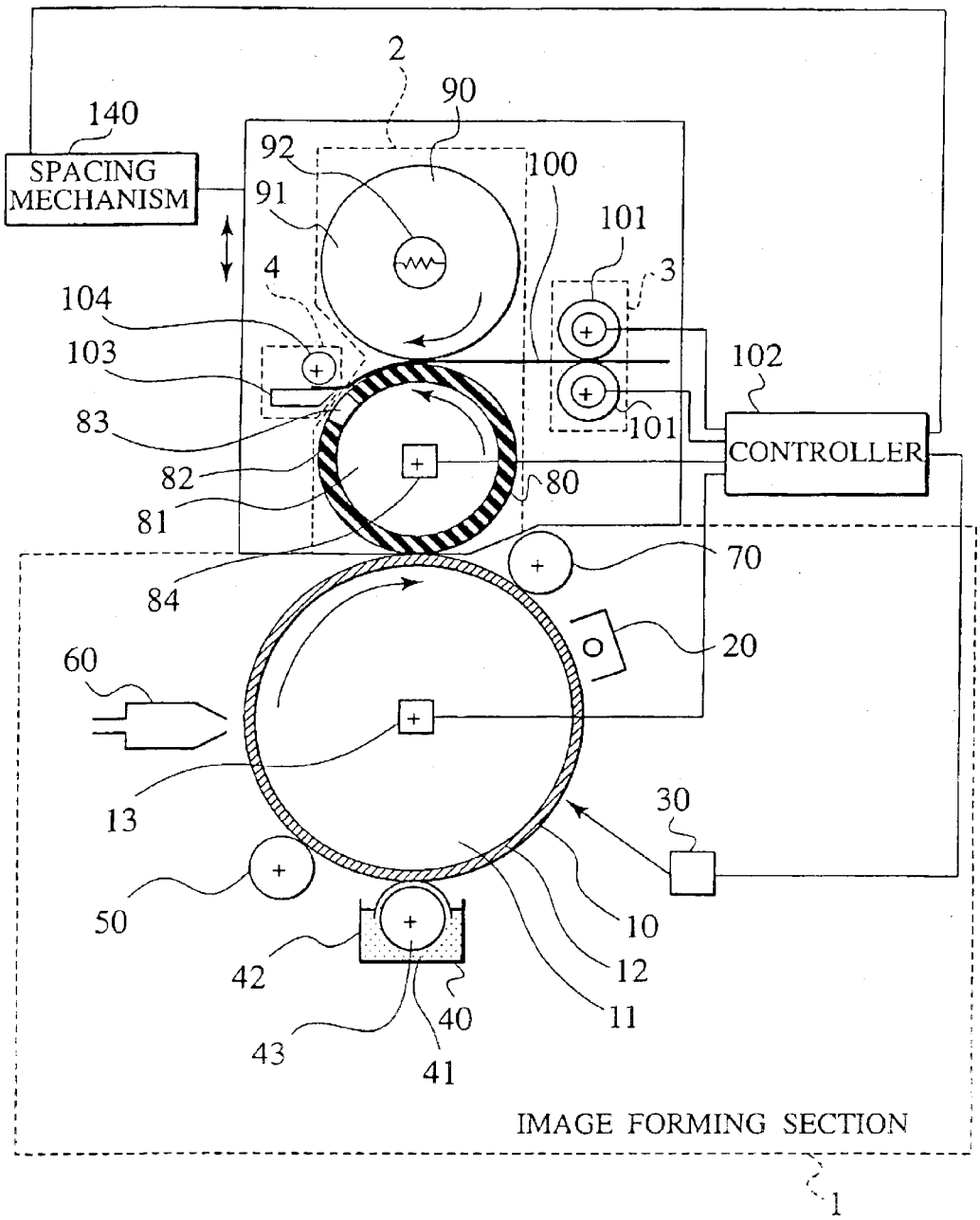
FIG. 9 is a schematic diagram of an image forming apparatus according to still another embodiment of the present invention.

A fourth embodiment of the present invention will be described with reference to FIG. 9. FIG. 9 is a schematic diagram illustrating an image forming apparatus of this embodiment.

The image forming apparatus of this embodiment forms images by an indirect transfer method in wet electrophotography using liquid toner, like the image forming apparatus of the first embodiment. Specifically, the image forming apparatus of this embodiment includes, as shown in FIG. 9, an image forming section 1, an image transferring section 2, a feeding mechanism 3, a separating mechanism 4, a controller 102 and a spacing mechanism 140.

Only the difference of the image forming apparatus of this embodiment from the image forming apparatus of the first embodiment will be described below.

The spacing mechanism 140 moves the image transferring section 2, feeding mechanism 3 and separating mechanism 4 (or only the image transferring section 2 and a paper feeding mechanism 3, which applies hereinafter) in the vertical direction in accordance with directions from the controller 102 so as to control the distance between the photosensitive drum 10 and the intermediate transfer roller 80.

Specifically, the spacing mechanism 140 controls the distance between the photosensitive drum 10 and the intermediate transfer roller 80 based on the rotational position of the intermediate transfer roller 80 detected by a rotary encoder 84 as will be described below.

During the formation of an image on the photosensitive drum 10, the image forming section 1 and the image transferring section are spaced apart from one another. The controller 102 controls the intermediate transfer roller 80 based on the output of the encoder 84 so that a release area 83 reaches a transfer position (right below in FIG. 9) and waits in that position. The exposure device 30 starts the exposure of the photosensitive drum 10 at predetermined timing (an output value of the encoder 13 at that time is designated as P5). Controller 102 calculates or stores in advance an output value of the encoder 13 at the time when a position on the photosensitive drum 10 to be brought into contact with the release area 83 on the intermediate transfer roller 80 reaches the transfer position after P5 (this value is referred to as P6). When an output value of the encoder 13 is P6, the controller 102 causes the spacing mechanism 140 to operate and causes the intermediate transfer roller 80 to rotate so as to bring the image forming section 1 and the image transferring section 2 into contact with one another to start the image transfer operation.

As a result, the release area 83 on the intermediate transfer roller 80 is brought into contact with a predetermined portion on the photosensitive drum 10. The waiting position of the release area 83 does not need to be the transfer position. With the knowledge of the position of the release area 83 obtained from the encoder 84, the adjustment of exposure timing, rotation start timing of the intermediate transfer roller 80 and the contact timing of the photosensitive drum 10 and the intermediate transfer roller 80 allows transfer at a desired position.

Other components of the image forming apparatus in this embodiment are identical to those of the image forming apparatus in the first embodiment.

Operation of Image Forming Apparatus in Embodiment 4

The operation of the image forming apparatus of this embodiment is identical to that of the image forming apparatus of the first embodiment except for the following.

In the operation of the image forming apparatus of this embodiment, at step S7, the spacing mechanism 140 moves the image transferring section 2, paper feeding mechanism 3 and separating mechanism 4 downward to establish contact between the photosensitive drum 10 and the intermediate transfer roller 80. Thereafter, a dried toner image formed on the photosensitive drum 10 is transferred to a surface of the intermediate transfer roller 80 under the influence of pressure in a nip area formed between contact portions of the photosensitive drum 10 and the intermediate transfer roller 80.

During the operation, the spacing mechanism 140 moves the image transferring section 2, paper feeding mechanism 3 and separating mechanism 4 downward so that the release area (second area) 83 formed on the elastic layer 82 of the intermediate transfer roller 80 is put on an area rotationally ahead of the area where the image (dried toner image) is formed on the photosensitive drum 10 (image formed area).

Modification

The present invention facilitates detachment of the recording medium 100 after an image (dried toner image) formed on an image carrying medium having elasticity (intermediate transfer roller 80 in the above embodiments) is transferred onto the recording medium 100, and thus can be applied to various methods of forming an image on the image carrying medium. The above-described embodiments are applied to wet electrophotography in which a liquid toner image formed on the photosensitive layer 12 is transferred onto the intermediate transfer roller 80 under pressure. The above embodiments are also applicable to electrophtography in which an electric field is used for transfer. Toner particles used may be powder particles. The present invention does not necessarily require the use of a photoconductor and is also applicable to a method of forming an electrostatic latent image directly on an insulating material using a solid ion head or the like for the formation of a toner particle image. Further, the present invention is not limited to electrophotography and is also applicable to a method of forming an ink image directly on an image carrying medium using an ink-jet recording head or the like. The present embodiments have been described on single-color recording but are also applicable to multi-color recording.

Various modifications will become possible for those skilled in the art after receiving the teachings of the present disclosure without departing from the scope thereof.

What is claimed is:

1. A method for forming an image comprising:

carrying an image formed with toner particles on a surface of an image carrier;

transferring said image from the surface of an image carrier to a first area of an intermediate transfer medium, said intermediate transfer medium including said first area and a second area having adhesion lower than that of said first area; and transferring said image from said first area to a recording medium fed by a feeding mechanism.

2. A method as set forth in claim 1, wherein said feeding mechanism feeds said recording medium to said intermediate transfer medium in a manner that the front end of said recording medium is positioned on said second area.

3. A method as set forth in claim 1, further comprising;

detaching said recording medium adhering to said intermediate transfer medium by a separating mechanism; and ejecting said detached recording medium by said separating mechanism.

4. A method as set forth in claim 1, further comprising roughening a surface of said intermediate transfer medium to form said second area.

5. A method as set forth in claim 1, further comprising applying a low adhesion material to a surface of said intermediate transfer medium to form said second area.

6. A method as set forth in claim 1, further comprising:

performing exposure by an exposure device provided adjacent said image carrier so as to form said image; and controlling exposure timing by said exposure device based on the rotational position of said intermediate transfer medium by a controller.

7. A method as set forth in claim 6, further comprising detecting the rotational position of said intermediate transfer medium by a rotary encoder.

8. A method as set forth in claim 6, further comprising detecting the rotational position of said intermediate transfer medium by an external sensor.

9. A method as set in claim 1, further comprising controlling the distance between said image carrier and said intermediate transfer medium based on the rotational position of the image carrier by a spacing mechanism.

10. A method as set forth in claim 1, further comprising forming said image on the surface of said image carrier using a liquid developer with toner particles dispersed therein.

11. A method for forming an image comprising:

carrying an image formed with toner particles on a surface of an image carrier;

forming a release area having adhesion lower than that of the surface of an intermediate transfer medium at a portion of said intermediate transfer medium to which a feeding mechanism feeds the front end of a recording medium, by a release area forming mechanism;

transferring said image from the surface of said image carrier to said intermediate transfer medium;

transferring said image from said release area to said recording medium fed by said feeding mechanism; and removing said release area by a release area removing mechanism.

12. A method as set forth in claim 11, further comprising:

detaching said recording medium adhering to said intermediate transfer medium; and ejecting said detached recording medium.

13. A method as set forth in claim 11, wherein said release area forming mechanism forms said release area by applying metal oxide particles, acryl particles, silicon particles, polyurethane particles, nylon particles, olefin particles or Teflon particles to a portion of said intermediate transfer medium to which the front end of said recording medium is fed.

14. A method as set forth in claim 11, further comprising controlling timing of the formation of said release area by said release area forming mechanism based on the rotational position of said image carrier, by a controller.

15. A method as set forth in claim 11, further comprising forming said image on the surface of said image carrier using a liquid developer with toner particles dispersed therein.

* * * * *